US007007860B2

(12) United States Patent
Dongming et al.

(10) Patent No.: US 7,007,860 B2
(45) Date of Patent: Mar. 7, 2006

(54) PLUNGER CAVITY PRESSURE CONTROL FOR A HYDRAULICALLY-ACTUATED FUEL INJECTOR

(75) Inventors: Tan Dongming, Dunlap, IL (US); Thomas R. McClure, Washington, IL (US); Scott R. Schuricht, Normal, IL (US); Wang Yongxin, Bloomington, IL (US)

(73) Assignee: Caterpillar Inc., Peoria, IL (US)

( * ) Notice: Subject to any disclaimer, the term of this patent is extended or adjusted under 35 U.S.C. 154(b) by 231 days.

(21) Appl. No.: 10/231,812

(22) Filed: Aug. 30, 2002

(65) Prior Publication Data

US 2004/0046056 A1 Mar. 11, 2004

(51) Int. Cl.
*F02D 1/06* (2006.01)

(52) U.S. Cl. ..... 239/5; 239/88; 239/90; 239/96; 239/124; 239/127; 239/533.9; 123/90.12; 251/57

(58) Field of Classification Search ..... 239/88, 239/90, 96, 124, 127, 533.2, 533.3, 533.8, 239/533.9, 1, 5; 123/90.12; 251/11, 48, 251/57

See application file for complete search history.

(56) References Cited

U.S. PATENT DOCUMENTS

| | | | | |
|---|---|---|---|---|
| 4,437,644 | A * | 3/1984 | Wilmers | 251/11 |
| 5,265,804 | A * | 11/1993 | Brunel | 239/88 |
| 5,299,738 | A | 4/1994 | Genter et al. | |
| 6,047,899 | A * | 4/2000 | Graves | 239/90 |
| 6,412,705 | B1 * | 7/2002 | Desai et al. | 239/124 |
| 6,631,853 | B1 * | 10/2003 | Lenk et al. | 239/90 |
| 6,663,014 | B1 * | 12/2003 | Depayva et al. | 239/90 |

* cited by examiner

*Primary Examiner*—Steven J. Ganey

(57) ABSTRACT

A fuel injector in an engine includes a spring cavity, a piston, a plunger, a spring, a fuel cavity, and a stop plate. The piston is hydraulically controlled to force the plunger down to compress fuel in the fuel cavity. However, under certain conditions, the plunger can contact the stop plate and/or the spring can become overcompressed. Both of these conditions can cause damage to the fuel injector. The present invention locates a pressure equalization channel in such a way as to dampen the motion of the piston to prevent this damage to the fuel injector.

16 Claims, 4 Drawing Sheets

PLUNGER CAVITY PRESSURE CONTROL FOR A HYDRAULICALLY-ACTUATED FUEL INJECTOR

TECHNICAL FIELD

This invention pertains to a pressure control for a piston-type device and, more particularly, to a pressure control which prevents the fuel plunger in a hydraulically-actuated fuel injector from contacting the stop plate of the fuel injector.

BACKGROUND

A fuel injector is commonly used to pressurize and atomize fuel in an internal combustion engine. In a common hydraulically-actuated fuel injector, a piston and plunger system in a spring cavity transfers hydraulic fluid pressure to the fuel. The piston moves reciprocally up and down within the spring cavity, and the motion of the piston causes the plunger to move, as well. First, fuel is introduced into a fuel cavity beneath the plunger, and hydraulic pressure on the piston forces the plunger down into the fuel cavity to compress the fuel. Since the fuel cavity and plunger are of a smaller cross-section than the spring cavity and piston, the force from the piston through the plunger and to the fuel cavity is magnified accordingly in a known manner for greater efficiency of compression.

Next, one of two things can happen. The plunger can contact, or "bottom out" on, a stop plate at the bottom of the fuel cavity and the plunger is consequently stopped and ready for the next stage of the compression cycle. Often the plunger/stop plate collision can damage one or both components, so this is generally only a secondary method of stopping the plunger. Alternately and usually preferably, the fuel or another fluid present in the fuel or spring cavity becomes pressurized until the fluid's resistance to further compression resists and/or stops the motion of at least one of the plunger and the piston. The latter condition is referred to in the art as a "hydraulic lock", in which a fluid cannot be compressed any more by the outside pressure placed upon it, and is of primary interest in the below description.

Regardless of the plunger stop mechanism, the compressed fuel is injected into the combustion chamber in a known manner at any suitable point in the plunger motion cycle, thereby vacating the fuel cavity. Finally, a piston spring in the spring cavity forces the piston back up to prepare the fuel injector for the next compression cycle. Hundreds or even thousands of these high-speed and high-stress reciprocal fuel compression cycles occur every minute, which makes efficient and robust operation of the various components of the fuel injector a priority.

Often hydraulic fluid under pressure seeps past the piston and into the spring cavity below the piston during operation of the fuel injector. Since the hydraulic fluid could build up in the spring cavity and hydraulically lock the piston as described above before the fuel is fully pressurized for injection, it is common for a vent hole to be provided at the bottom of the spring cavity to carry any extant hydraulic fluid to a vent line, this evacuation being normally propelled by the downstroke of the piston. This vent hole may also function as an air intake to prevent a vacuum being formed in the spring cavity on the piston upstroke and slowing the motion of the piston.

The stop plate mentioned previously is commonly located at an end of the fuel cavity opposite the plunger. The stop plate acts partially to form the fuel cavity and partially to halt motion of the plunger in a situation when the fuel or hydraulic fluid in the fuel cavity or the spring cavity is insufficient to hydraulically lock the plunger and piston in the preferred manner. Situations that can cause a low fuel situation and subsequent "bottoming out" of the plunger (allowing the plunger to contact the stop plate) include fuel transfer pump failure, air in the fuel supply line, fuel pressure regulator valve failure, the engine's being simply allowed to run out of fuel through neglect or malfunction, and the like. Additionally, while bottoming out is generally not a preferred plunger function, design features and choices with respect to other components may allow the plunger to occasionally bottom out in an otherwise normally functioning fuel injector.

There are two main malfunctions that can result when a plunger bottoms out. The high impact velocity of the plunger on the stop plate can cause material failure and stress damage to one or both components, particularly if repeated contact occurs. Also, and more seriously, the piston spring can overtravel or become overcompressed, either of these causing a permanent reduction in the height of the piston spring or even breakage of that spring. Since the piston spring is the only force outside the hydraulic lock acting to resist downward motion of the plunger, a shortened piston spring will probably allow the plunger to bottom out repeatedly until the fuel injector totally fails because of component breakage. It is estimated that this total injector failure occurs within about twenty seconds of the piston spring failure, leaving little to no time for the problem to be detected and the engine shut down to prevent such failure. When the fuel injector fails, the engine effectively loses power in that cylinder and numerous well-known problems typically result.

Additionally, there are many other applications in the field for a piston assembly such as that described above. Any hydraulic piston assembly working to compress a fluid in much the same manner, perhaps in an injection molding or glue-applying situation, would be subject to these or similar difficulties. Since the overall structure of these piston assemblies is analogous to the fuel injector described, it is intuitively obvious that many different applications can be effected by piston assembly failure as described. Therefore, a solution to the piston assembly failure is widely sought.

The present invention is directed to overcoming one or more of the problems as set forth above.

SUMMARY OF THE INVENTION

In an embodiment of the present invention, a hydraulic piston assembly is disclosed. The hydraulic piston assembly includes a piston body, a cavity disposed within the piston body, a piston disposed within the cavity and moveable between a first position and a second position, and a vent hole in the piston body which selectively connects the cavity to a low pressure.

In an embodiment of the present invention, a hydraulic piston assembly is disclosed. The hydraulic piston assembly includes a piston body, a cavity disposed within the piston body, a piston disposed within the cavity and separating the cavity into a first subcavity and a second subcavity, and a piston hole in the piston.

In an embodiment of the present invention, a hydraulically-actuated fuel injector is disclosed. The hydraulically-actuated fuel injector includes a piston body defining a piston axis, a spring cavity located inside the piston body and having a first cavity end and a second cavity end spaced apart from the first cavity end along the piston axis, a piston located substantially inside the spring cavity and moveable along the piston axis between a first position and a second position, and a pressure equalization channel.

In an embodiment of the present invention, a method of controlling the motion of a piston in a fuel injector, wherein the fuel injector includes a spring cavity having a first cavity end and a second cavity end, is disclosed. The method includes the steps of locating the piston within the spring cavity, moving a plunger with the piston, and providing a piston spring within the spring cavity and adapted to provide positive pressure to the piston in a first direction. The method also includes the steps of providing pressurized hydraulic fluid at a first portion of the spring cavity located near the first cavity end, exerting positive pressure on the piston in a second direction, and allowing the pressurized hydraulic fluid to enter a second portion of the spring cavity located between the piston and the second cavity end. The method also includes the steps of substantially equalizing the pressures between the first and second portions of the spring cavity and slowing the piston.

In an embodiment of the present invention, a hydraulic damping device for a piston mechanism is disclosed. The hydraulic damping device includes an elongate piston body, a piston, a hydraulic source, and a pressure equalizing system. The elongate piston body has a first end and a second end. The piston is adapted to move reciprocally between the first and second ends, thereby defining a variable volume first chamber adjacent the first end and a variable volume second chamber adjacent the second end. The hydraulic source is adapted to supply hydraulic fluid to the piston body. The pressure equalizing system is adapted to substantially equalize pressures of the hydraulic fluid in the first and second chambers.

DETAILED DESCRIPTION

Figure 1:
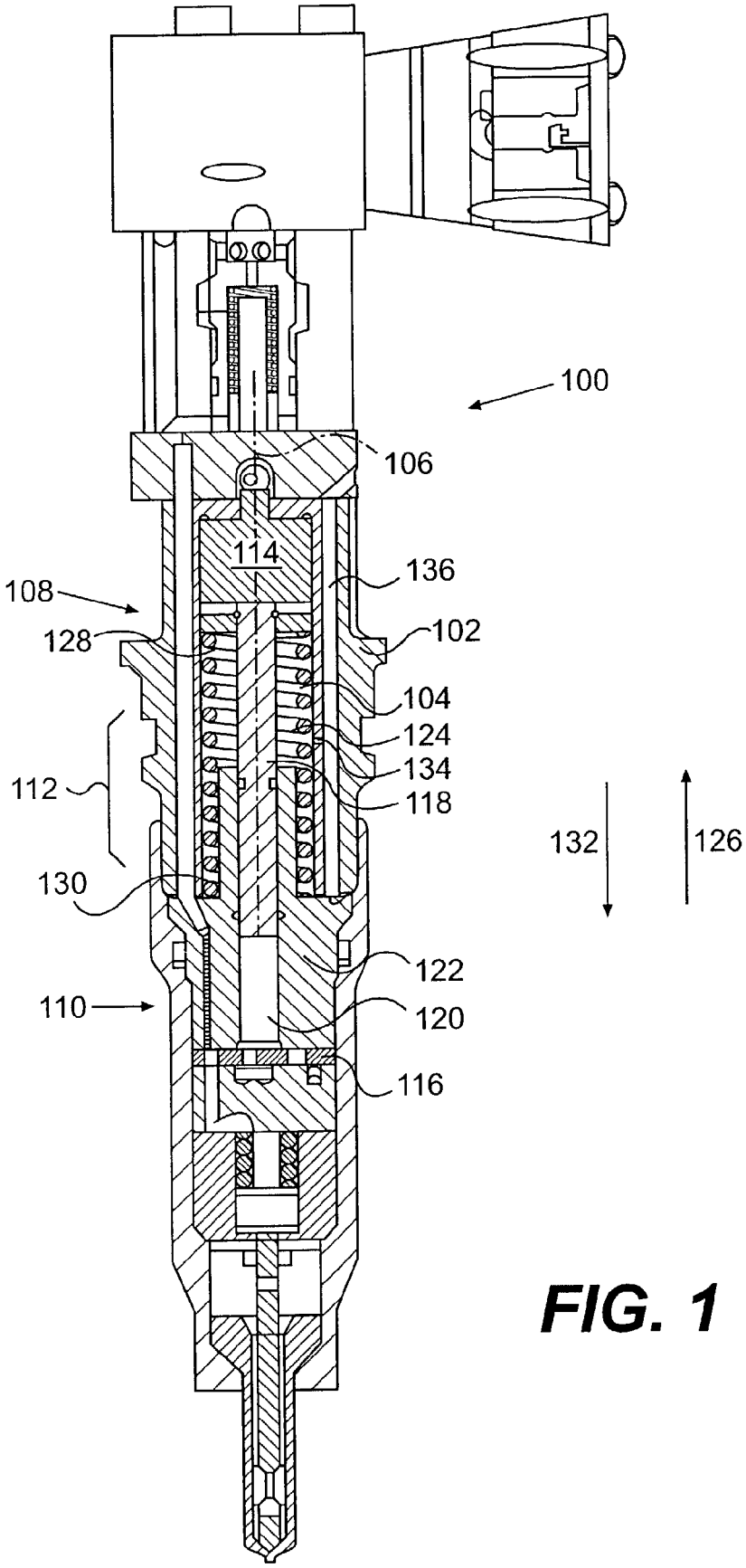
FIG. 1 is a cutaway side view of a fuel injector incorporating a preferred embodiment of the present invention.

FIG. 1 depicts a fuel injector 100 having a piston body 102 and a spring cavity 104. The piston body 102 defines a piston axis 106. The spring cavity 104 includes a first cavity end, shown generally at 108, a second cavity end spaced apart from the first cavity end 108 along the piston axis 106, shown generally at 110, and a cavity midsection located along the piston axis 106 between the first cavity end 108 and the second cavity end 110, and shown generally at 112. The operation of a fuel injector is substantially described above, but certain aspects of the operation will be further clarified as needed.

A piston 114 is located, at least initially, near the first cavity end 108 and is adapted to travel in a reciprocating motion within the spring cavity 104, driven by hydraulic fluid. The piston 114 will be located in the cavity midsection 112 during at least a portion of the reciprocating travel. A stop plate 116 is located near the second cavity end 110. A plunger 118 is attached to, or in a contacting relationship with, the piston 114. The plunger 118 may be the same diameter as the piston 114, but is preferably of a reduced diameter as shown in the Figs., for pressure intensifying reasons well-known in the art.

The plunger 118 and the stop plate 116, along with portions of the spring cavity 104, define a fuel cavity 120 near the second cavity end 110. A barrel 122 at least partially surrounds the fuel cavity 120 and at least a portion of the plunger 118 to help define the fuel cavity 120 and to guide the plunger 118. Preferably, the barrel 122 creates a reduced-diameter fuel cavity 120 as shown so that the pressure-intensifying effects of the varied diameters of the piston 114 and plunger 118 may be utilized. The barrel 122 is adapted to provide fuel to the fuel cavity 120 from a fuel source (not shown), in a known manner.

Should the fuel injector 100 not include a barrel 122, the fuel cavity 120 may be formed as an extension of the spring cavity 104 or by any other suitable means. In this case, fuel may be provided to the fuel cavity 120 in any other suitable manner, and a component should be provided which separates the fuel cavity 120 from the spring cavity 104 to contain the fuel.

Preferably, a piston spring 124 or other suitable resistor member is located substantially within the spring cavity 104 and positioned so as to provide positive pressure in a first direction 126 to the piston 114. The piston spring 124 has a first spring end 128 which contacts the piston 114 and a second spring end 130 spaced apart from the first spring end 128 along the piston axis 106 which contacts the barrel 122 or, if the fuel injector 100 does not include a barrel 122, contacts the second cavity end 110. The piston spring 114 commonly surrounds the plunger 118 within the spring cavity 104.

Pressurized hydraulic fluid is provided to the spring cavity 104 near the first cavity end 108. The hydraulic fluid builds up between the first cavity end 108 and the piston 114 to overcome the pressure provided by the piston spring 124 and propel the piston 114 along the piston axis 106 in a second direction 132. The motion of the piston 114 causes the plunger 118 to move in the second direction 132 and subsequently reduce the volume of the fuel cavity 120, therefore increasing the pressure of the fuel within the cavity. When the pressure in the first direction 126 becomes substantially equal to the pressure in the second direction 132, no disparate hydraulic force is acting on the piston 114 in either the first or second directions 126,132, and the piston 114 will naturally cease motion because of the lack of a "pushing" force. The pressurized hydraulic fluid from area of the first cavity end 108 is then released in a known manner as, or after, the now-pressurized fuel is transferred to the combustion chamber of the engine. Then, the pressure in the second direction 132 overcomes the pressure in the first direction to push the piston 114 back toward the first cavity end 108. A new fuel injector cycle then begins.

The pressure in the first direction 126 is substantially provided by a combination of the fuel's resistance to pressure (if there is fuel in the fuel cavity 120), the spring force provided by the piston spring 114, and the resistance to pressure of any hydraulic fluid which happens to be extant in the spring cavity 104 below the piston 114. By extant, what is meant is that the hydraulic fluid has either seeped past the piston 114 as described above or has been purposely routed past or through the piston; either way, the "extant" hydraulic fluid has come to be present in the spring cavity 104 between the piston 114 and the second cavity end 110. The pressure in the second direction 132 is mainly from the pressurized hydraulic fluid which drives the piston 114. In order to equalize these two pressures, a pressure equalization channel adapted to facilitate the transfer of hydraulic fluid in a desired manner is provided by the present invention.

Figure 2A:
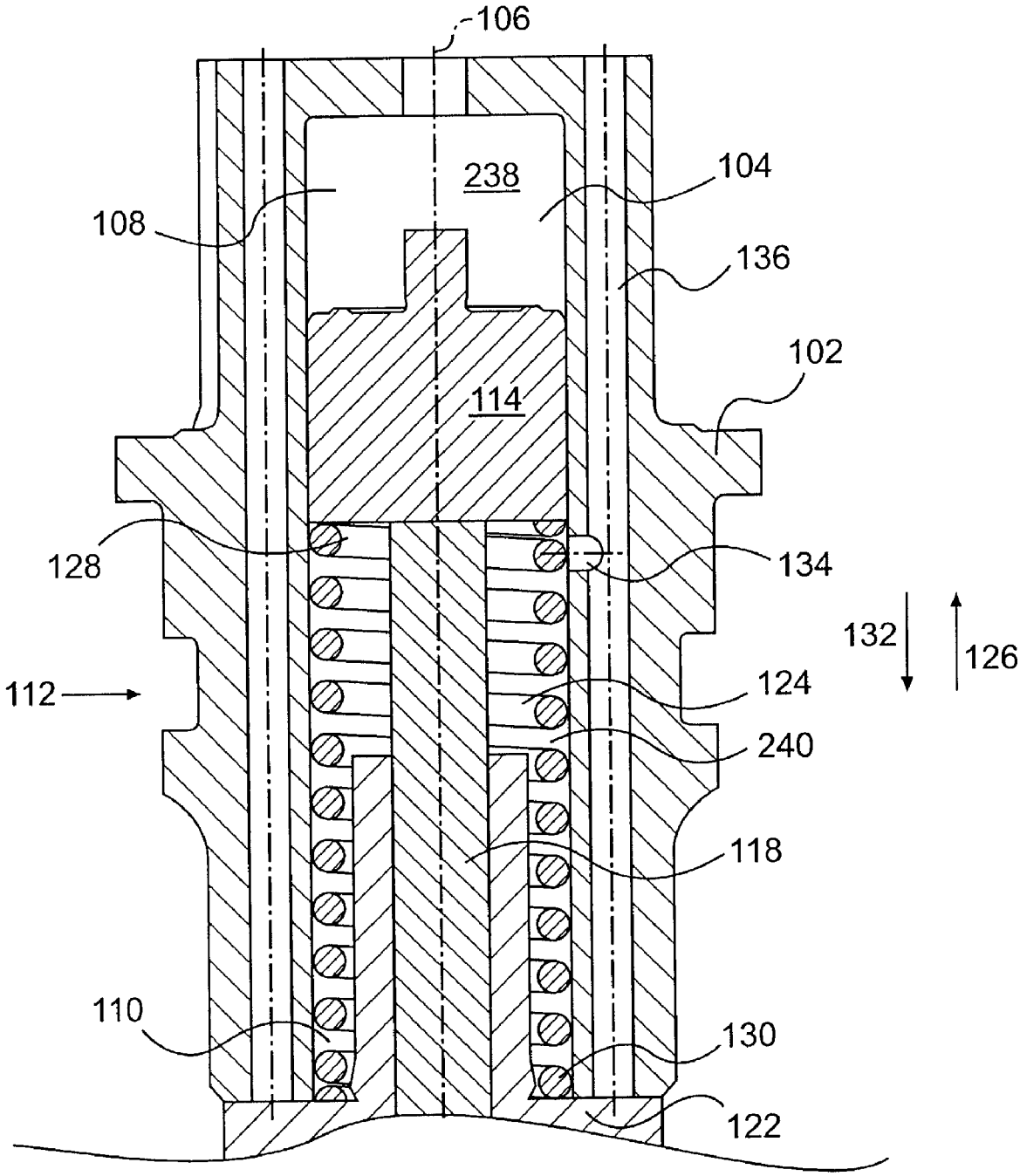
FIG. 2*a* is a partial cutaway side view of a fuel injector incorporating a preferred embodiment of the present invention.

In a first preferred embodiment of the present invention shown in FIGS. 1, 2*a,* and 2*b,* the pressure equalization channel takes the form of a vent hole 134 provided in the cavity midsection 112. The vent hole 134 is fluidically connected to a vent line 136 or other low pressure in a known manner. The precise location and dimensions of the vent hole 134 are important to the proper functioning of the present invention but are highly dependent upon the relative dimensions of the other components of the fuel injector 100 and thus do not form a necessary component of the present invention. It is intuitively obvious that experimentation will enable the proper placement of the vent hole 134 in the cavity midsection 112 in practice. It is advantageous, as described below, for the vent hole 134 to be located such that the piston 114 completely covers and blocks the vent hole 134 when the piston 114 is at or near a lower limit of travel in the second direction 132.

Figure 3:
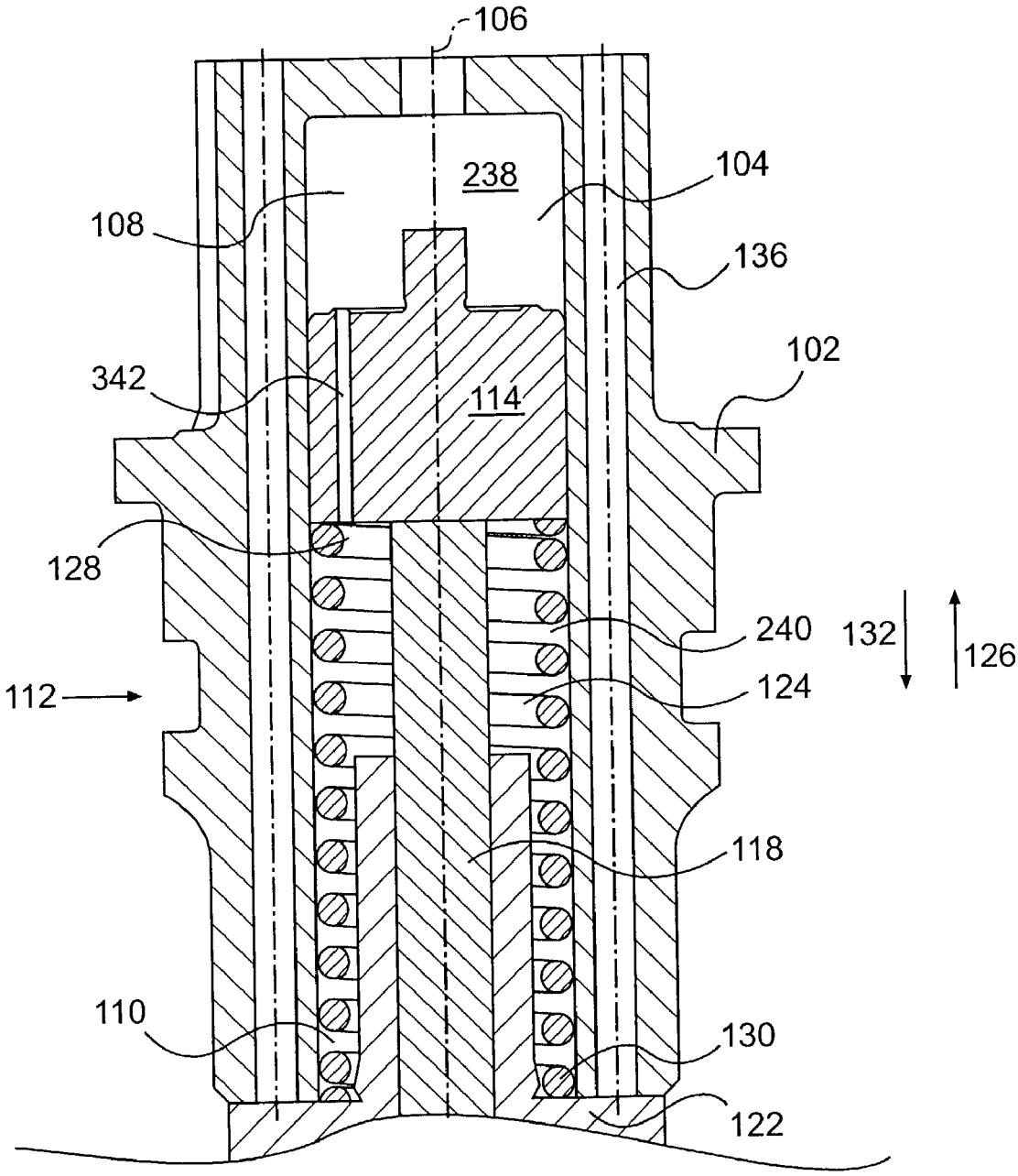
FIG. 3 is a partial cutaway side view of a fuel injector incorporating another preferred embodiment of the present invention.

In a second preferred embodiment of the present invention shown in FIG. 3, the pressure equalization channel takes the form of a piston hole 342 in the body of the piston 114. The piston 114 divides the spring cavity 104 into first and second portions or subcavities 238,240, as shown best in FIGS. 2*a,* 2*b,* and 3. The first and second subcavities 238,240 are variable in volume as the piston 114 moves through its reciprocal cycle. The pressure in each subcavity comes from the sources described above—normally either pressurized hydraulic fluid driving the motion of the piston 114 or hydraulic fluid which has become extant in the spring cavity 104 below the piston 114. The piston hole 342 directs pressurized hydraulic fluid through the piston 114 and into the second subcavity 240 in order to controllably set up a hydraulic lock situation which will stop the piston 114 when the pressures in the first and second subcavities 238,240 are substantially the same.

The exact configuration of the piston hole 342 is not important, so long as it fluidically connects the first and second subcavities 238,240, though it is obvious that a piston hole 342 substantially parallel to the piston axis 106 will provide a direct path for the hydraulic fluid to travel quickly through the piston 114. A piston hole 342 using a labyrinthine structure, an integral valve, or the like would be considered a pressure equalization channel, as well.

The substances used in the operation of the fuel injector 100 have been described as "fuel" and "hydraulic fluid", but the exact nature of the substances is inconsequential, except as their properties affect other operations of the engine or another larger device encompassing the present invention. The substances may be different from one another or may be the same substance. Oils, petroleum distillates, water, compressed air, other fluids, and the like may be used without affecting the operation of the present invention.

INDUSTRIAL APPLICABILITY

Figure 2B:
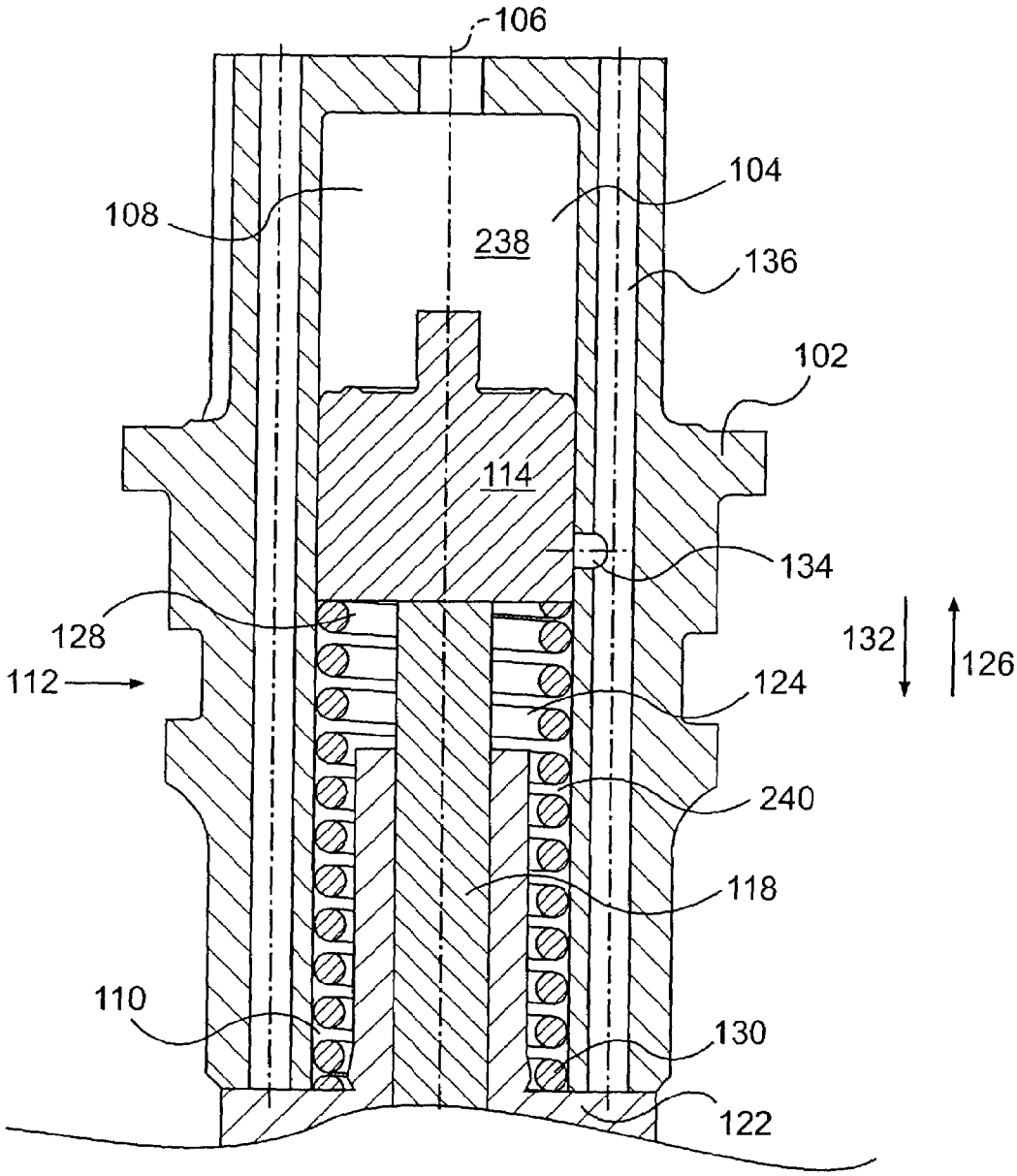
FIG. 2*b* is a partial cutaway side view of a fuel injector incorporating a preferred embodiment of the present invention.

FIGS. 2*a* and 2*b* depict different stages in the reciprocal compression cycle of the piston 114 within the fuel injector 100 in the first preferred embodiment of the present invention. In FIG. 2*a,* hydraulic fluid enters the spring cavity 104 at the first cavity end 108 and forces the piston 114 in the second direction 132. The piston 114 then pushes on the first spring end 128, causing the piston spring 124 to compress.

As the pressurized hydraulic fluid enters the spring cavity 104, often a portion of the hydraulic fluid seeps past the piston 114 and becomes extant in the cavity midsection 112. This seepage is an inherent characteristic of a hydraulically-actuated fuel injector 100. In the embodiment shown in FIG. 3, hydraulic fluid is also purposely directed into the second subcavity 240 to supplement the seepage and remains in the spring cavity 104. However, in the embodiment shown in FIGS. 2*a* and 2*b,* at least a portion of the hydraulic fluid that becomes extant within the spring cavity 104 is forced out of the vent hole 134 and carried away by the vent line 136 in a known manner as the piston 114 travels in the second direction 132.

FIG. 2*b* depicts the piston 114 at or near a lower travel limit. The piston spring 124 in FIG. 2*b* is almost fully compressed and may overtravel or become overcompressed, probably causing permanent damage to the fuel injector 100, if the piston 114 continues in the second direction 132. However, the vent hole 134 is now blocked by the piston 114, and hydraulic fluid is therefore trapped in the spring cavity 104. The trapped hydraulic fluid becomes pressurized by the piston 114 action, and the pressure equalizes in the first and second subcavities 238,240, thus providing a damping function to prevent the piston 114 from further travel. The damping function slows or stops the piston 114 because the trapped hydraulic fluid sets up a hydraulic lock in the second subcavity 240. The pressure of the fluid in the second subcavity 240 acts oppositely on the piston 114 as does the pressurized fluid pushing the piston 114 in the second direction 132. When these oppositely directed forces become substantially equal, that is, when the pressures in the first and second subcavities 238,240 are about the same, there is no disparity of pressure pushing the piston 114 in a certain direction. The piston 114 thus is forced to slow or stop, as any pressure on the piston 114 from the second direction 132 is opposed or canceled out by pressure from the first direction 126.

Preferably, the pressure equalizing channel will be located and the piston spring 124 sized to allow the plunger 118 to travel far enough to compress fuel in the fuel cavity 120 as desired, but not far enough that the plunger 118 contacts the stop plate 116. The damping function provided by the plunger cavity pressure control of the present invention can prevent the piston spring 124 from overcompressing in a no-fuel situation for in the range of 5–10 minutes, rather than the approximately twenty seconds provided by the prior art. This extra time allows for remedial action to be taken before the fuel injector 100 suffers expensive and wasteful damage.

While aspects of the present invention have been particularly shown and described with reference to the preferred embodiments above, it will be understood by those skilled in the art that various additional embodiments may be contemplated without departing from the spirit and scope of the present invention. For example, the dimensions of the vent hole 134 or piston hole 340 could differ, the fuel injector 100 could be of another known type, the piston assembly could be used in an application other than a fuel injector (such as injection molding, glue application, metering substances, or the like), or the various fluids involved could be supplied or vented in a different manner. However, a device or method incorporating such an embodiment should be understood to fall within the scope of the present invention as determined based upon the claims below and any equivalents thereof.

The apparatus and method of certain embodiments of the present invention when compared with other methods and apparatus may have certain features worthy of incorporating into the design, manufacture, and operation of fuel injectors. In addition, the present invention may contain other properties that have not been discovered yet. It should be understood that while a preferred embodiment is described in connection with a fuel injector, the present invention is readily adaptable to provide similar functions for other mechanisms. Other aspects, objects, and advantages of the present invention can be obtained from a study of the drawings, the disclosure, and the appended claims.

What is claimed is:

1. A hydraulically-actuated fuel injector, comprising:

a piston body defining a piston axis;

a spring cavity located inside the piston body and having a first cavity end and a second cavity end spaced apart from the first cavity end along the piston axis;

a piston located substantially inside the spring cavity and moveable along the piston axis between a first position and a second position; and a pressure equalization channel disposed in the piston body and opening on one end into the second cavity, but being blocked by the piston when the piston is located between the first and second positions.

2. The hydraulically-actuated fuel injector of claim 1, including a plunger attached to the piston.

3. The hydraulically-actuated fuel injector of claim 2, including a barrel located at the second cavity end, substantially surrounding the fuel cavity and at least a portion of the plunger, and adapted to provide fuel to the fuel cavity from a fuel source.

4. The hydraulically-actuated fuel injector of claim 3, including a piston spring located within the spring cavity, and having a first spring end contacting the piston and a second spring end spaced apart from the first spring end along the piston axis and contacting the barrel.

5. The hydraulically-actuated fuel injector of claim 1, wherein the pressure equalization channel is a vent hole in the piston body that opens on an opposite end to a vent line.

6. The hydraulically-actuated fuel injector of claim 5, wherein the vent hole is open when the piston at the first position.

7. The hydraulically-actuated fuel injector of claim 5, wherein the vent hole is blocked by the piston when the piston is at the second position.

8. A hydraulic piston assembly, comprising:

a piston body;

a cavity disposed within the piston body;

a piston disposed within the cavity and moveable between a first position and a second position, and the piston including opposing hydraulic surfaces;

a vent hole in the piston body selectively connecting the cavity to a low pressure; and the vent hole being open to the cavity when the piston is in the first position, but the piston blocking the vent hole when in the second position.

9. The piston assembly of claim 8, including a spring disposed in the cavity and adapted to bias the piston toward the first position.

10. A hydraulic damping device for a piston mechanism, comprising:

an elongate piston body having a first end and a second end;

a piston adapted to move reciprocally between the first and second ends, thereby defining a variable volume first chamber adjacent the first end and a variable volume second chamber adjacent the second end;

a fluid pressurization plunger operably coupled with said piston;

a hydraulic source adapted to supply hydraulic fluid to the piston body; and a pressure equalizing system adapted to substantially equalize pressures of the hydraulic fluid in the first and second chambers before the piston reaches the second end.

11. A hydraulic damping device for a piston mechanism, comprising:

an elongate piston body having a first end and a second end;

a piston adapted to move reciprocally between the first and second ends, thereby defining a variable volume first chamber adjacent the first end and a variable volume second chamber adjacent the second end;

a hydraulic source adapted to supply hydraulic fluid to the piston body; and a pressure equalizing system adapted to substantially equalize pressures of the hydraulic fluid in the first and second chambers before the piston reaches the second end;

wherein the pressure equalizing system includes a vent hole located in the piston body and fluidically connected to a low pressure.

12. The hydraulic damping device of claim 11, wherein the vent hole becomes selectively blocked by the piston as the piston moves toward the second end.

13. A method of reducing overtravel of a piston, comprising the steps of:

hydraulically moving a piston from a first position toward a second position to compress a hydraulic fluid;

stopping the piston before reaching the second position at least in part by trapping the hydraulic fluid in a cavity;

retracting the piston toward the first position at least in part by biasing the piston toward the first position; and the biasing step is performed by compressing a spring in the cavity.

14. A method of reducing overtravel of a piston comprising the steps of:

hydraulically moving a piston from a first position toward a second position;

stopping the piston before reaching the second position at least in part by trapping hydraulic fluid in a cavity;

retracting the piston toward the first position at least in part by biasing the piston toward the first position; and the biasing step is performed by compressing a spring in the cavity wherein the stopping step is preceded by a step of closing a vent hole that opens into the cavity with the piston.

15. The method of claim 14 further comprising the step of pressurizing fuel in a fuel injector with a plunger coupled to the piston when the piston is moving from the first position toward the second position.

16. The method of claim 15 including the step of locating the vent hole such that the vent hole is open to the cavity when the piston is in its first position, but closed when the piston is approaching the second position.

* * * * *

UNITED STATES PATENT AND TRADEMARK OFFICE

CERTIFICATE OF CORRECTION

PATENT NO. : 7,007,860 B2
APPLICATION NO. : 10/231812
DATED : March 7, 2006
INVENTOR(S) : Thomas R. McClure et al.

It is certified that error appears in the above-identified patent and that said Letters Patent is hereby corrected as shown below:

TITLE PAGE, ITEM (75)
Inventors: Dongming Tan, Dunlap, IL (US)
Thomas R. McClure, Washington, IL (US)
Scott R. Schuricht, Normal, IL (US)
Yongxin Wang, Bloomington, IL (US)

Signed and Sealed this

Twenty-ninth Day of August, 2006

JON W. DUDAS
*Director of the United States Patent and Trademark Office*